United States Patent [19]

Tallis

[11] 4,204,349

[45] May 27, 1980

[54] CORNER TOOTH CONSTRUCTION

[75] Inventor: Thomas J. Tallis, Dowagiac, Mich.

[73] Assignee: Clark Equipment Company, Buchanan, Mich.

[21] Appl. No.: 972,551

[22] Filed: Dec. 22, 1978

[51] Int. Cl.[2] ..... E02F 9/28

[52] U.S. Cl. ..... 37/141 RS; 172/777

[58] Field of Search ..... 37/141 R, 141 T, 142 R, 37/142 A; 172/777

[56] References Cited

U.S. PATENT DOCUMENTS

| | | | |
|---|---|---|---|
| 3,736,675 | 6/1973 | Shankwitz et al. | 37/141 R |
| 3,748,762 | 7/1973 | Tarrant | 37/141 T |
| 3,851,413 | 12/1974 | Lukavich | 37/141 T |
| 3,961,788 | 6/1976 | Helton et al. | 37/141 R X |
| 3,967,398 | 7/1976 | Stepe | 37/141 R |
| 3,984,928 | 10/1976 | Oke et al. | 37/141 R |
| 4,007,550 | 2/1977 | Stepe | 37/141 T |
| 4,047,312 | 9/1977 | Stepe | 37/141 R |
| 4,055,223 | 10/1977 | Casey et al. | 172/777 |
| 4,071,967 | 2/1978 | Klett | 37/141 T |

FOREIGN PATENT DOCUMENTS

| | | | |
|---|---|---|---|
| 2006657 | 2/1970 | Fed. Rep. of Germany | 37/141 R |

*Primary Examiner*—E. H. Eickholt

*Attorney, Agent, or Firm*—Kenneth C. Witt

[57] ABSTRACT

A corner tooth construction for a loader bucket in which a corner tooth is welded to a vertically disposed corner reinforcing member and a cutting edge member as an integral part of the bucket structure. The corner tooth can be readily installed or replaced without affecting the constructional welds of the bucket and without impairing the integrity of the bucket.

5 Claims, 18 Drawing Figures

CORNER TOOTH CONSTRUCTION

BACKGROUND OF THE INVENTION

1. Field of the Invention

This invention relates to a corner tooth construction for a loader bucket.

2. Description of the Prior Art

It is known to use teeth on the cutting edge of loader buckets and other similar earth handling implements to increase the ability of such implements to penetrate the earth or rocks or other materials to be handled. Such teeth at or near the lower corners of loader buckets are particularly helpful. It is known also that the lower corners of loader buckets are especially subject to damage and wear. Consequently, corner teeth for loader buckets have been made as a part of replaceable structures which may be detached by removing bolts or pins and replaced. Examples of such structures are shown in U.S. Pat. Nos. 3,967,398, 4,007,550, and 4,047,312. U.S. Pat. No. 3,748,762 shows detachable side cutters for an excavator bucket.

It is known also to weld a corner tooth adapter to the outside of the end structure of a bulldozer blade and this is illustrated in U.S. Pat. No. 4,055,223.

It is known to utilize vertical corner reinforcement members for loader buckets and such vertical corner members are illustrated by U.S. Pat. Nos. 3,736,675 and 3,984,928.

It is known to install a tooth between the vertical corner member and the cutting edge member by welding, but this makes it difficult and costly to replace the tooth, and moreover the constructional welds are involved and hence the integrity of the entire bucket may be affected.

It is known to construct a loader bucket utilizing a corner tooth with a notch in it to fit the vertical corner member, with the tooth being welded both to the vertical corner member and the cutting edge. However, this weakens the tooth and makes it more subject to failure.

It is known also to form a corner tooth as a part of a vertical corner member which is installed during manufacture of the bucket, and such a combined structural element may be made by casting, forging or a flame cutting process. However, when the corner tooth must be replaced, the entire combined corner member and tooth must be removed and replaced, and accordingly such procedure is costly and time consuming, as well as involving the constructional welds and the integrity of the bucket.

SUMMARY OF THE INVENTION

The present invention provides a corner tooth construction for a loader bucket in which the tooth is welded in such a way that it becomes an integral part of the bucket. Yet in this construction the corner tooth can be easily and inexpensively installed, removed and replaced without affecting constructional welds or impairing the integrity of the bucket. The installation and replacement is done by welding and the removal by a flame cutting procedure.

DESCRIPTION OF THE PREFERRED EMBODIMENTS

Figure 1:
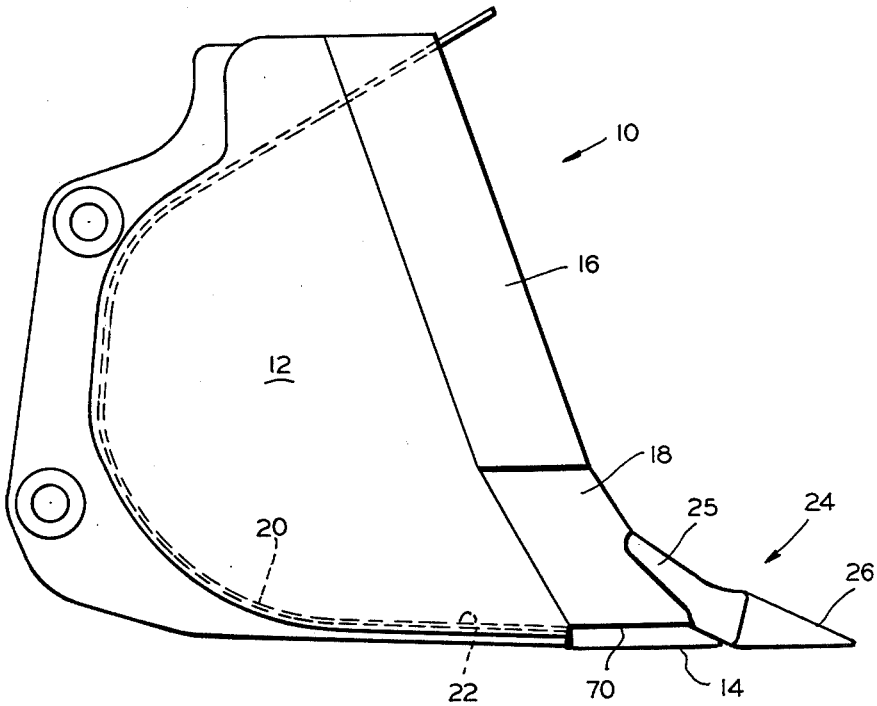
FIG. 1 of the drawing shows a loader bucket in accordance with one embodiment of this invention.

FIG. 1 of the drawing shows a loader bucket 10 comprising a pair of laterally spaced side walls 12 (one shown) having a cutting edge 14 along the bottom of the bucket at the front. The bucket 10 includes side cutting edges 16 (one shown) and a corner reinforcing member 18 for each corner of the bucket, such reinforcing member being thicker than the side wall and side cutting edge. The bucket also includes a sheet member 20 which forms the bottom 22 of the bucket and also extends rearwardly and upwardly in the form disclosed to form other walls of the bucket 10. All of the foregoing are welded together to form an integral bucket structure.

Figure 2:
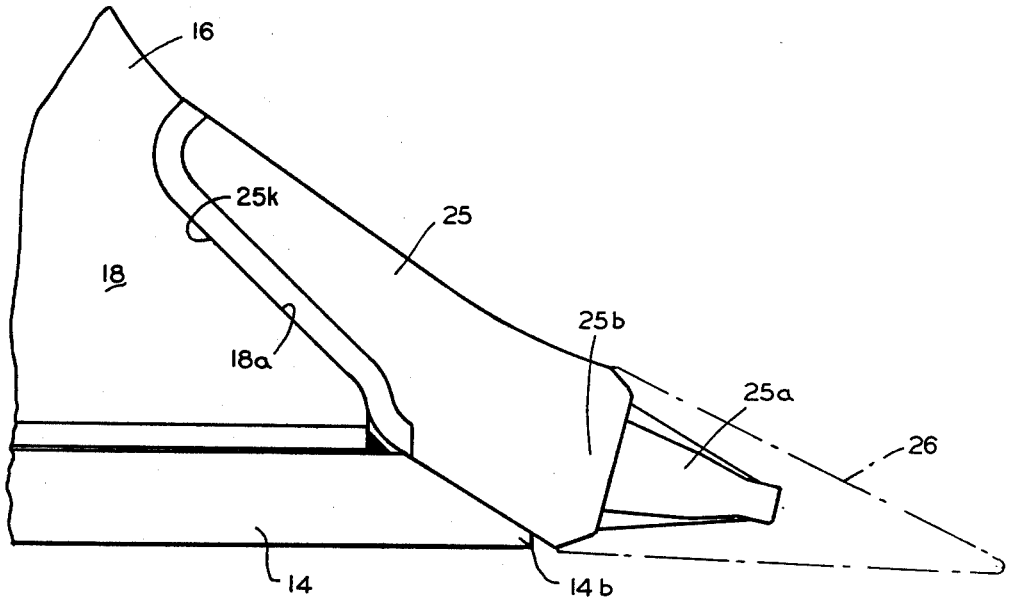
FIG. 2 is an enlarged fragmentary view of the lower right portion of FIG. 1.

The bucket structure also includes a pair of corner teeth 24, one of which appears in FIG. 1. As shown, the corner teeth are comprised of two parts, one a shank or adapter portion 25 which is welded to and made an integral part of the bucket structure in a manner described hereinafter. The other part of the tooth is the tip 26 wich is a hardened member that is readily replaceable on the shank portion. FIG. 2 is a fragmentary enlarged view of the lower right portion of FIG. 1 showing the tooth and associated structure in greater detail, with the replaceable tip shown in phantom. The shank 25 has a projecting portion **25*a* to which the tip 26** is connected.

Figure 3:
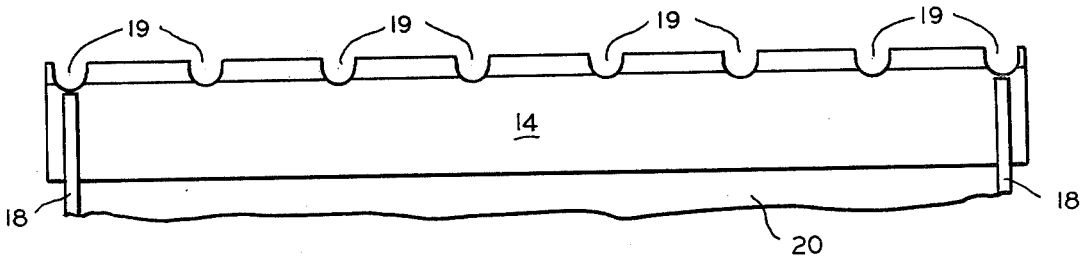
FIG. 3 is a top plan view of the cutting edge of the bucket of FIG. 1.

FIG. 3 is a top plan view of the cutting edge 14 of the bucket, in accordance with the first embodiment of the invention, before any cutting teeth have been installed on it. The corner members 18 are shown in place in this view. In this embodiment there are cutout portions or recesses 19 along the front of the cutting edge for eight teeth, six of these being regular teeth and the other two at the ends, being corner teeth in accordance with the present invention. The corner members 18 are centered with respect to the recesses 19 in front of them.

Figure 4:
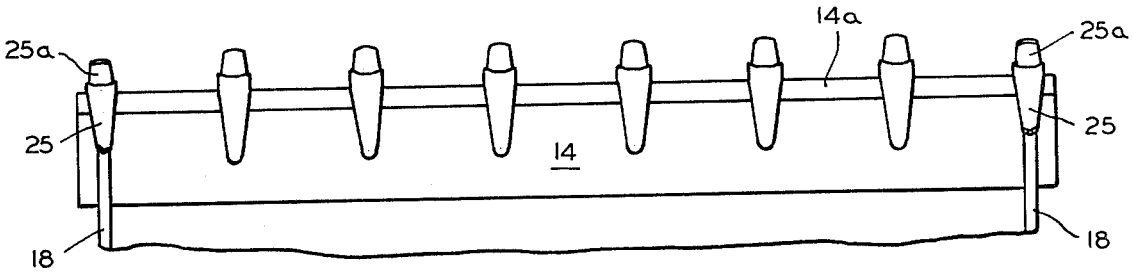
FIG. 4 is the same as FIG. 3 except showing the tooth shanks in place.

FIG. 4 is the same as FIG. 3 except showing all eight of the tooth shanks in place, including the two end tooth shanks 25 according to this invention.

Figure 5:
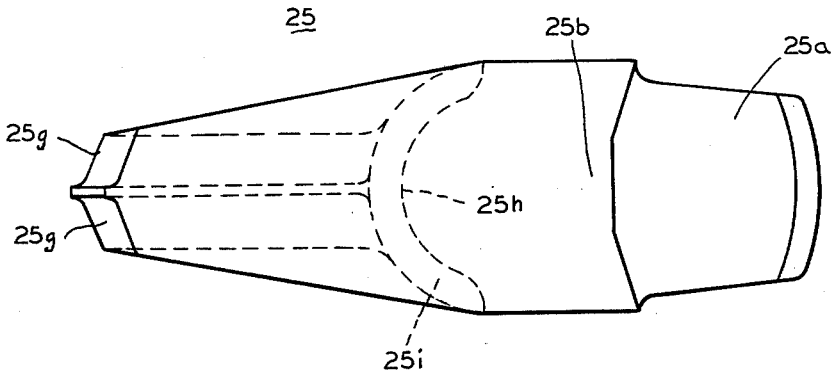
FIG. 5 is a top view of a corner tooth shank member according to the first embodiment of this invention.
Figure 6:
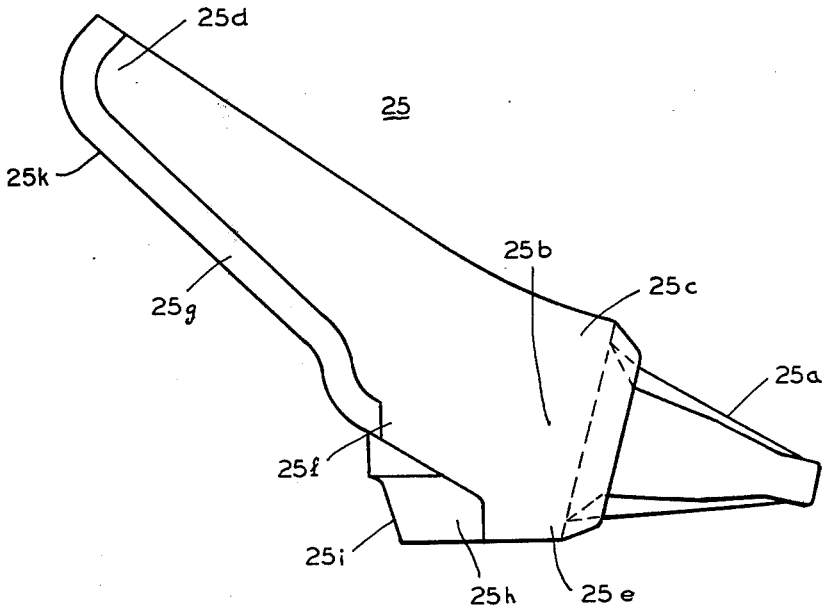
FIG 6 is a side view of a corner tooth shank member of FIG. 5.

FIGS. 5 and 6 show top and side views respectively of a corner tooth shank member 25 in accordance with the first embodiment of this invention. This shank member, when installed as a part of the bucket, abuts the forwardly and downwardly extending bevel surface 14*a* along the front of cutting edge 14. The shank member 25 is made so that it has an enlarged portion 25*b* located immediately in front of and above the forward extremity 14*b* of the cutting edge. See FIGS. 2, 5, and 6. The enlarged portion 25*b* is thicker than corner member 18 and from portion 25*b* both the upper portion and the lower portion of the tooth shank taper rearwardly to the same thickness as the corner member 18. The shank 25 has a three dimensional taper from top forward portion 25*c* to the top rear portion 25*d*, from the bottom forward portion at 25*e* to the bottom rear portion at 25*f*, and from portion 25*c* to portion 25*f*, whereby the thickness of the shank 25 along a curved rear surface 25*k* is the same as the thickness of corner member 18.

Corner member 18 is provided with an inwardly curved surface 18*a* which mates with the outwardly curved surface 25*k* of the shank member. When shank member 25 is installed it is solidly welded along the contiguous abutting surfaces on both the inside and the outside of the bucket 10, and as shown in FIG. 6, shank 25 is provided with a chamfer 25*g* (one shown) on both such edges to provide for adequate weld metal for maximum strength welding. Shank 25 also is provided, in this embodiment, with a semicircular portion at 25*h* which mates with the rear semicircular portion of recess 19 and a chamfer 25*a* is provided around portion 25*h* for receipt of weld metal for another maximum strength weld on the bottom surface of the cutting edge member 14 of the bucket structure.

Figure 7:
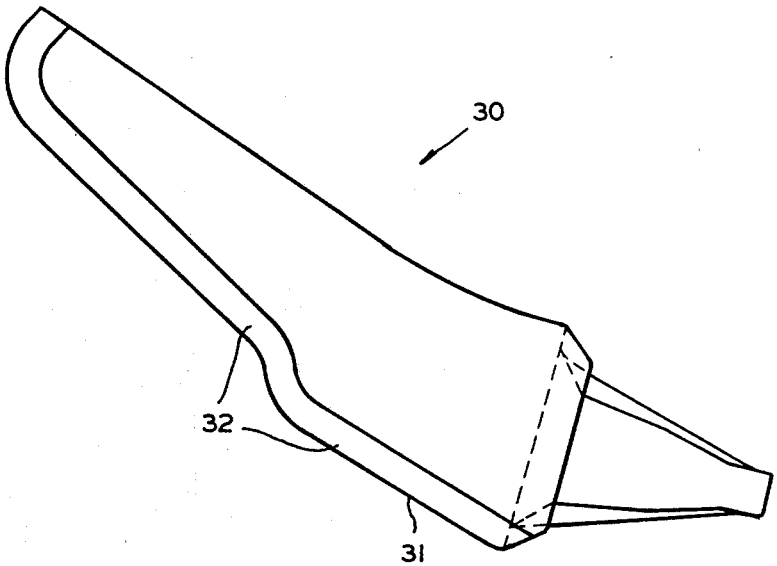
FIG. 7 is an enlarged fragmentary view, similar to FIG. 2, but illustrating a second embodiment of the invention.

FIG. 7 of the drawing shows a tooth shank 30 which illustrates a second embodiment of the invention. Shank 30 is the same as shank 25 of the first embodiment except that it does not include the downwardly projecting portion 25*h*. When tooth 30 is used for the corner teeth of the bucket the cutting edge 14 does not include any recesses such as are shown at 19 in FIG. 2 for the first embodiment, and the corner teeth as well as the other teeth are installed directly on the bevel surface 14*a* of the cutting edge, with the surface 31 of shank 30 in contact with surface 14*a* for each corner tooth. Shank 30 has a chamfer 32 (one shown) along both the inner and outer lower edges for welding the shank to both the corner member 18 and cutting edge 14.

Figure 8:
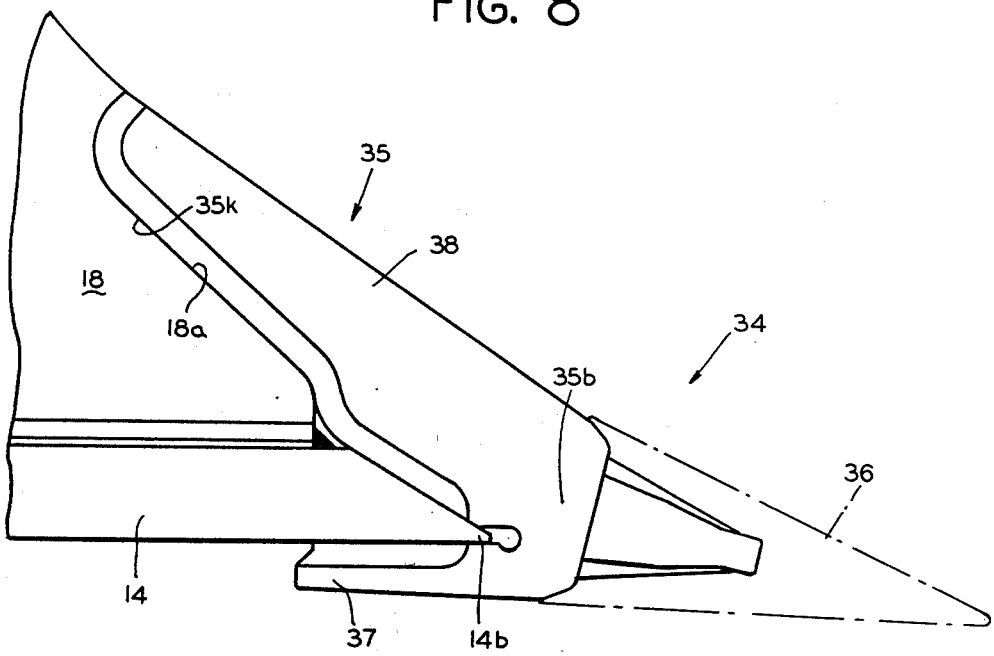
FIG. 8 is an enlarged fragmentary view, similar to FIG. 2, but illustrating a third embodiment of the invention.
Figure 9:
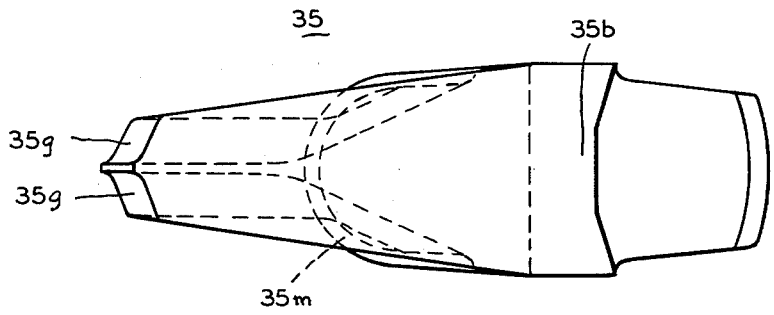
FIG. 9 is a top view of a corner tooth shank member according to the embodiment of FIG. 8.
Figure 10:
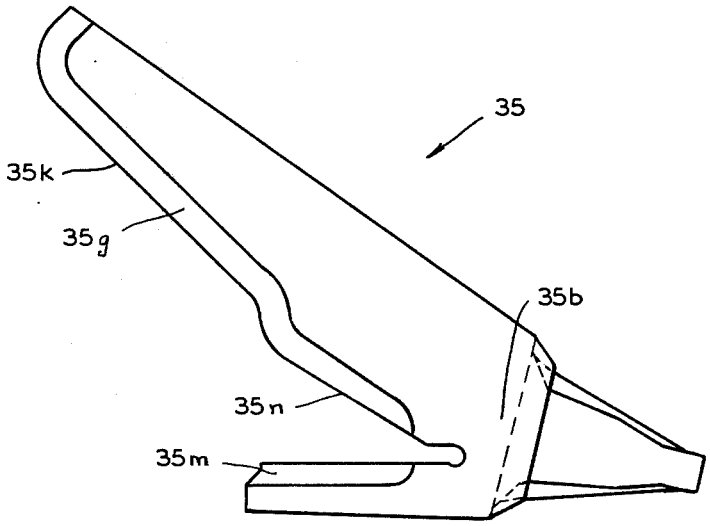
FIG. 10 is a side view of the corner tooth shank member of FIG. 9.

FIG. 8 of the drawing shows a view similar to FIG. 2 but illustrating a third embodiment of the invention which includes a tooth 34. In FIG. 8, and also in FIGS. 9, 10, and 11, which show the same embodiment, the tooth shank is indicated by the number 35. A tip portion 36 is indicated in phantom in FIG. 8. Tooth 34 differs from tooth 24 and tooth shank 30 in that tooth 34 has a reentrant or lower leg portion 37 extending beneath the cutting edge 14 in addition to the main body or upper leg portion indicated at 38. This embodiment is similar to the second embodiment in that the cutting edge does not have recesses for the corner teeth.

The tooth 34 is similar to tooth 24 in that it includes an enlarged portion 35*b* located near the front extremity 14*b*. From the enlarged portion 35*b* the shank 35 tapers upwardly and rearwardly the same as shank 25, that is, there is a three dimensional taper from enlarged portion 35*b* to the curved surface 35*k* whereby the thickness at the edge 35*k* is the same as the thickness of corner member 18. These are chamfers 35*g* along both the inner and outer edges of curved surface 35*k* to provide for welding. As with the other embodiments, surface 35*k* mates with surface 18*a* of the corner member. A surface 35*n* on shank 35 abuts the bevel surface of 14*a* similarly to the other embodiment. Shank 35 differs from shank 25 in that there is a chamfer 35*m* along both sides of lower leg portion 37 for welding such leg portion to the bottom of the cutting edge 14.

Figure 12:
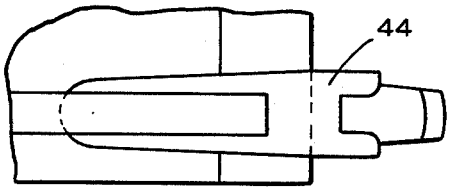
PRIOR ART FIG. 12
FIG. 12 is a fragmentary top view showing a prior art construction.
Figure 13:
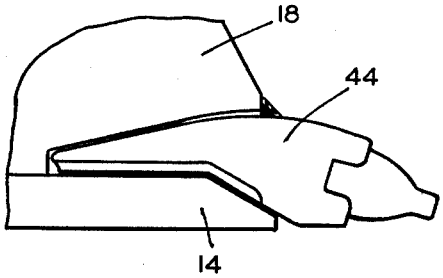
FIG. 13 is a side view of FIG. 12.

FIGS. 12 and 13 of the drawing show one of the prior art constructions mentioned previously, that is, the one in which a tooth is installed between the vertical corner member of a bucket and the cutting edge member. As is seen best in FIG. 13, the corner member 18 has had a generally wedge shaped portion removed, and a tooth 44 is installed in the resulting space, being welded to both sides of the corner member along the top of the tooth shank and being welded to the upper surface of the cutting edge along both sides of the tooth shank at the bottom. This construction may be adequate from the standpoint of strength and durability but it is difficult and costly to replace the shank 44 when necessary, and involves the constructional welds of the bucket.

Figure 14:
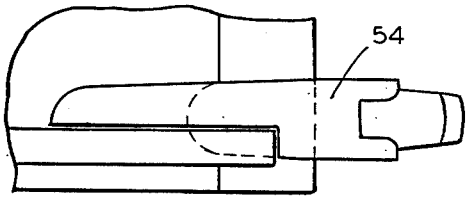
FIG. 14 is a fragmentary top view showing another prior art construction.
Figure 15:
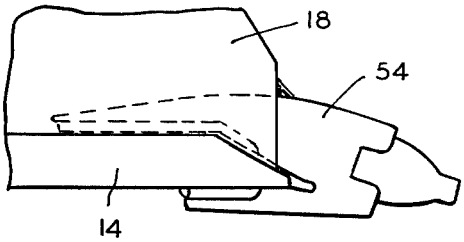
FIG. 15 is a side view of FIG. 14.

FIGS. 14 and 15 show another prior art construction which was also mentioned previously, that is, one in which the corner tooth shank has a notch cut in it to fit the vertical corner member. As seen in FIGS. 14 and 15 a notch has been cut from the shank indicated at 54 and the remaining portion is installed inside of corner member 18 and welded thereto. The shank 54 of FIGS. 14 and 15 also includes a reentrant or lower leg portion located beneath the cutting edge.

Figure 16:
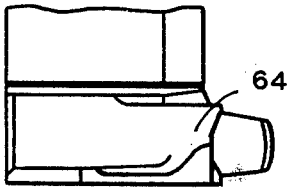
FIG. 16 is a fragmentary top view of another prior art construction.
Figure 17:
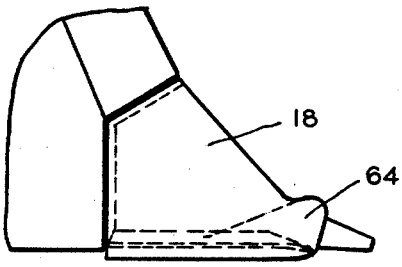
FIG. 17 is a side view of FIG. 16.
Figure 18:
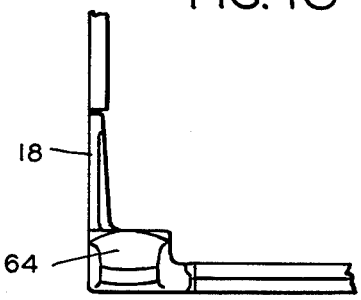
FIG. 18 is a front view of FIG. 16.

FIGS. 16, 17 and 18 show another prior art construction which was also mentioned previously, that is, one in which the corner tooth is formed as an integral part of the vertical corner member by casting, forging, or a flame cutting process. As may be seen in these three figures, the tooth shank portion indicated at 64 is formed as a part of a corner member 18. This construction also may be satisfactory from the standpoint of strength and durability but it is even more costly and time consuming than the embodiment of FIGS. 12 and 13 when it is necessary to replace the tooth shank because the entire corner member, including vertical reinforcement portion 18 and the tooth shank portion 64, must be removed and replaced, and again the constructional welds are involved in such an operation.

The utilization of the present invention requires a minimum of alteration of a regular bucket without teeth, especially for embodiments 2 and 3. The first embodiment requires recesses to be cut out of the cutting edge member but apart from this the only alteration in a regular bucket which is required to utilize this invention is to cut out a portion from each corner reinforcing member 18 to provide the recess defined by curved surface 18*a*. This causes the removal of only a small portion of each corner reinforcing member and does not significantly affect the integrity and operation of the bucket as compared to the operation of the normal configuration of the same bucket without teeth.

It will be understood that it is not intended that the tooth shanks in accordance with this invention are to be changed frequently. The replaceable tips are intended to take the brunt of the wear and provision is made for changing them frequently. However, in the kind of service to which buckets of this character are subjected it happens that the shank portions of the teeth also must be changed from time to time, particularly the corner teeth, and the present invention provides for such changing with a minimum of difficulty and no disturbance of the constructional welds of the bucket. One of the shanks can be changed merely by cutting the welds on one shank and welding in another.

Illustrative of the constructional welds referred to is the weld 70 between the cutting edge and the corner reinforcement member. See FIG. 1. This weld and the others joining the corner reinforcing members and the cutting edge members are very important because when the bucket is tipped back in a prying action during excavating operations tension is exerted on these welds tending to pull the cutting edge member downwardly away from the corner reinforcing members. By utilizing the present invention the weld 70 is not reduced significantly in length compared to its length in a normal bucket of the same type except without teeth and it is not necessary to disturb such constructional welds when tooth shanks are replaced in accordance with this invention.

A corollary of the foregoing is that an existing bucket can easily be adapted to employ this invention merely by cutting a suitable recess, as defined by curved edge 18*a*, in each corner member, and then welding on a tooth shank member.

Figure 11:
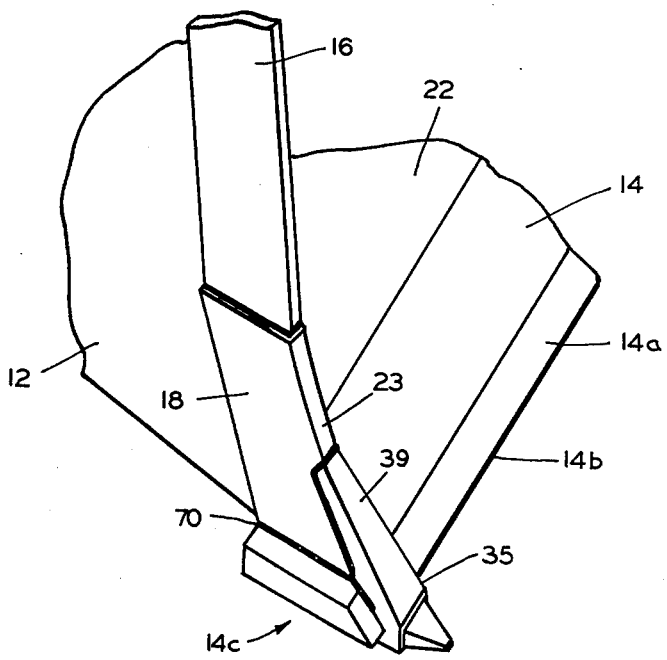
FIG. 11 is a perspective view of the third embodiment.

It will be understood that the tooth shanks of this invention require the described enlarged portions in order to provide sufficient strength to hold the tooth tips, which are supported by each such enlarged portion. The tapered construction of the tooth shanks provides for the transfer of these forces to the remainder of the bucket without undue stress concentrations and with a streamlined surface which minimizes interference with the movement of the material being handled by the bucket. The contiguous forward surfaces 39 and 23 respectively of the shank 35 and the corner reinforcing member 18 provide a smooth upward curve which does not obstruct the movement of the bucket through the material being handled. See FIG. 11. Also, as illustrated by FIG. 11, the projecting end portion 14*c* of the cutting edge 14 absorbs some of the wear and thus cuts down wear on other portions of the bucket corner structure. The lower legs 37 of the third embodiment of the invention likewise help cut down wear on the bottom surface of the cutting edge 14.

While I have described and illustrated herein preferred embodiments of my invention illustrating the best mode contemplated for carrying out the invention, it will be understood by those skilled in the art that modifications may be made. I intend to cover by the appended claims all such modifications which fall within the true spirit and scope of my invention.

The description and claims define the invention in terms of a bucket in its normal loading position with reference to bottom, sides, front, and the like, but it will be understood that the bucket assumes other positions in operation.

I claim:

1. A loader bucket having a bottom wall, a cutting edge member along the front of the bottom wall, the cutting edge member having a forwardly and downwardly extending bevel surface, a side wall, a side cutting edge member along the front of the side wall, a vertically disposed corner member coplanar with the side wall and the side cutting edge member and of greater thickness than both, all of the foregoing welded into a unitary structure, and a downwardly and forwardly extending corner tooth shank forming an integral part of the loader bucket, the said tooth shank abutting on the bevel surface of the cutting edge member and also abutting the forward edge of the corner member, said tooth shank having an enlarged portion thicker than the corner member near the front extremity of the cutting edge member, said tooth shank having a tapered portion extending upwardly and rearwardly from said enlarged portion whereby both the inner and outer surfaces of the tooth shank blend smoothly with the contiguous inner and outer surfaces of the corner member, and the said tooth shank welded to the corner member along both said inner and outer contiguous surfaces.

2. A loader bucket as in claim 1 in which said cutting edge member has a recess in front of said corner member, said tooth shank includes a rearwardly projecting portion occupying said recess, and said shank and cutting edge are welded along contiguous bottom surfaces of said rearwardly projecting portion and said recess.

3. A loader bucket as in claim 1 in which the contiguous forward surfaces of said tooth shank and said corner member form a continuous upwardly curved surface.

4. A loader bucket as in claim 1 in which said tooth shank has a rearwardly extending leg portion beneath said cutting edge member, and said leg portion is welded to the bottom surface of the cutting edge member.

5. A loader bucket as in claim 1 in which the said abutting surface on the forward edge of the corner member is an inwardly curved surface and the corresponding abutting surface on the tooth shank is a mating outwardly curved surface.

* * * * *